US005238046A

United States Patent [19]

Guerard

[11] Patent Number: 5,238,046

[45] Date of Patent: Aug. 24, 1993

[54] METHOD OF MANUFACTURING A BIMETAL CASTING AND WEARING PART PRODUCED BY THIS METHOD

[75] Inventor: Norbert Guerard, Esneux, Belgium

[73] Assignee: Magotteaux International, Vaux-Sous-Chevremont, Belgium

[21] Appl. No.: 949,339

[22] Filed: Sep. 22, 1992

Related U.S. Application Data

[63] Continuation-in-part of Ser. No. 761,429, Sep. 17, 1991, abandoned.

[30] Foreign Application Priority Data

Sep. 20, 1990 [BE] Belgium ..... 09000895

[51] Int. Cl.[5] ..... B22D 19/06

[52] U.S. Cl. ..... 164/110; 164/111; 164/98

[58] Field of Search ..... 164/98, 110, 111, 112, 164/108

[56] References Cited

U.S. PATENT DOCUMENTS 45,318 12/1864 Coffee ..... 164/111
1,188,766 6/1916 Harrison ..... 164/111
1,787,526 1/1931 Honstain ..... 164/111
2,155,215 4/1939 Beament ..... 164/111
4,869,645 9/1989 Verpoort ..... 164/98

FOREIGN PATENT DOCUMENTS 2182875 5/1987 United Kingdom ..... 164/98

*Primary Examiner*—Mark Rosenbaum
*Assistant Examiner*—Erik R. Puknys
*Attorney, Agent, or Firm*—Schmeiser, Morelle & Watts

[57] ABSTRACT

Bimetal casting of wearing parts including a cast retaining part enclosing a plurality of inserts. The method consists in casting an insert in a first mould, disposing the insert thus cast in a second mould and in casting the part in this second mould around the insert in such a way as to form a mechanical bonding between the two castings. The wearing part thus cast advantageously comprises an insert having a high resistance to wear while the rest of the part is made of a more ductile material which is resistent to mechanical stresses. The primary application is in the realization of crushing wheels, termed ferrules, and crusher hammers.

6 Claims, 6 Drawing Sheets

METHOD OF MANUFACTURING A BIMETAL CASTING AND WEARING PART PRODUCED BY THIS METHOD

This application is a continuation-in-part of application Ser. No. 761,429, filed Sep. 17, 1991, now abandoned.

The present invention relates to a method of manufacturing a bimetal casting and a wearing part produced by this method, particularly ferrules and crusher hammers.

Many wearing parts, for example in the field of crushers, are subjected to high mechanical stresses in the mass and to high wear by abrasion on their working surface, such that it is desirable that these parts should have a high resistance to abrasion and a certain ductility to be able to resist mechanical shock stresses, and possibly to be able to be machined. Now, it is well known that these properties are not compatible. It is of course possible to choose a steel exhibiting a compromise between these two opposite properties, but this must necessarily be done to the detriment of resistance to wear or of ductility.

In order to avoid such compromises, it is known to produce composite parts in which the section exposed to abrasion is constituted by ferrochromium with a high resistance to abrasion supported by a core made from a more ductile steel. This allows the wear of the part to be reduced while allowing the core to be machined and avoiding its breakage during this operation. Furthermore, it is possible to reduce its manufacturing cost by a judicious choice of its components.

Several manufacturing methods of such composite or bimetal parts are known. Thus, for example, the Patent LU-64303 proposes a manufacturing method for composite parts by successive castings of materials having different or complementary properties. This technique however has two restrictions. Firstly, the method necessarily implies the existence of a horizontal separating surface between the two cast metals. Furthermore, the casting must be relatively massive to allow the successive casting of the two metals while obtaining a correct metallurgical bond between these metals. These two restrictions limit the field of application of the solution proposed by the abovementioned patent.

It is also known to produce bimetal wearing parts by welded assembly. Although, in theory, a welded assembly does not have limits at the level of the morphology of the components to be assembled, in practice such limits exist and they depend on the welding method used. Furthermore, all welding methods applied to fragile materials require a perfect control of their heating and cooling cycle, and a very accurate positioning of the surfaces to be assembled. The result of this is that a welded assembly is a relatively expensive technique and is of limited application.

It is also known to produce bimetal parts by brazed assembly. This technique offers the possibility of assembling components of various shapes, but it still requires a very accurate machining of the contact surfaces and positioning devices which are also very accurate.

High temperature brazing offers mechanical properties comparable with welding, but it requires meticulous operating precautions and the use of special furnaces, particularly vacuum furnaces, if its is desired to obtain a reliable assembly. This results in a relatively high manufacturing cost.

With regard to low temperature brazing, just like glueing, it is certainly less expensive but the mechanical characteristics of the assembly are distinctly inferior and even insufficient for highly stressed wearing parts.

These various techniques are in particular recommended by the document EP-A2-0,271,336 for the manufacture of crusher ferrules. The surface of such a ferrule is exposed to high tensions which generate cracks propagating through the support of the ferrule thus rendering the latter rapidly useless.

The U.S. Pat. No. 4,099,988 proposes the use of the technique of inserts for the production of bimetal armour plates, for blast furnaces. According to this patent, inserts are firstly cast in first moulds; these inserts are then placed in a second mould into which the part is cast around the inserts in order to form a metallurgical bonding between the inserts and the support material. This method has the disadvantage that the inserts undergo thermal shocks during the casting of the parts. The thermal shocks generate internal tensions and cracks which propagate not only through the inserts but, because of the metallurgical bonding also through the support. This disadvantage appears to a greater degree when the insertion rate is high, that is to say when the mass of the inserts is relatively large with respect to the mass of the support. In the instant case it is necessary, in order to ensure the formation of the metallurgical bond during the casting of the part, to further raise the casting temperature of the material which is cast secondly; this intensifies the thermal shocks and increases the risks of cracking of the inserts.

The purpose of the present invention is to provide a new method of manufacturing a bimetal casting having a high insertion rate, whose properties result not only from the individual properties of each component, but also from a useful synergic effect generated by the juxtaposition of the two components and due either to the morphology or to the dimensioning or to the choice of the materials of the components.

In order to achieve this objective, the present invention proposes a method of manufacturing a bimetal casting consisting in casting an insert in a first mould, in disposing the insert thus cast in a second mould, and in casting the part in this second mould around the insert, characterised in that the casting in the second mould is carried out in such a way as to avoid any metallurgical bond between the insert and the cast alloy, the bond being a mechanical bond due to an appropriate shape of the insert.

The invention also proposes a bimetal wearing part produced according to this method and comprising at least one insert made of a material with a high resistance to wear and a cast support made from a more ductile material resistant to mechanical stresses, in which the mass of the inserts represents at least 30% of the mass of the part, characterised by a mechanical bond between the insert or inserts and the support, the said mechanical bond being reinforced by an appropriate geometric shape of the insert.

Alternatively, the present invention proposes another valuable method for manufacturing a composite bimetal wearing part including inserts constituted by an outer section having two longitudinal sides made of a first metal alloy with a high resistance to wear and a cast support made from a second, more ductile metal alloy, resistant to mechanical stresses. The method generally comprises the steps of: (1) providing the inserts with at least one protruding rib on the longitudinal sides of the inserts; (2) disposing the inserts, one against (in contact with) the other, on a circumference of an axially symmetrical mould in such a way that adjacent inserts are separated by a spacing which is defined by the protruding ribs; and (3) casting a second more ductile metal into the mould so that the investment will fill the hollow space of the mould and form a radial fin between two adjacent inserts. The casting is carried out in a manner which avoids any metallurgical linkage between the insert alloy and the support alloy. Thus, the resulting bonds between the inserts and the support will be purely mechanical due to nonmixture of the alloys and the mechanical bonding per se will be effected by the unique and appropriate geometrical shapes and relief features of the inserts.

In order of avoid the formation of a metallurgical bond or linkage between the inserts and the support and in order to reduce the effect of thermal shocks, it is possible, depending on the massiveness of the inserts, to submit the latter to a preliminary preparation. This preparation can for example consist, when the massiveness of the inserts is not too great, in a simple heat treatment. When the massiveness increases, it is possible to provide the inserts with a refractory coating forming a thermal barrier. When the massiveness is very great, it is even possible to envisage providing the inserts with a ceramic coating.

The invention methodogy allows, by a judicious choice of the nature and morphology of the two components, the generation in service of a wear profile which will maintain or optimise the working of the part.

The invention also provides, by way of advantageous application, a crusher ferrule of cylindrical or truncated cone shape with a central bore for receiving a support hub constituted by a machinable ductile casting on the surface of which are longitudinally embedded, in the direction of the generatrix, wear inserts, each insert being separated from the two adjacent inserts by a radial fin constituted by a layer of the said ductile casting.

Each insert can comprise a section of substantially parallelepipedic shape constituting a wearing part which is radially prolonged towards the centre of the ferrule by a longitudinal narrowing having a "dovetail" shaped cross-section forming the zone of mechanical bond with the ductile casting. The "dovetail" shaped cross-section can also be replaced by channelled cross-sections.

The spacing between adjacent inserts can be determined by protruding radial ribs provided on the longitudinal sides of the inserts.

These ribs are in contact with the corresponding ribs or the longitudinal sides of the neighboring inserts and allow the inserts to form a "vault" after being placed in the mould. In this way the inserts will stay in their position while the second metal is cast to form the support.

The function played by the "dove tail" shaped cross-section, or the channelled cross-section, i.e., providing a zone for mechanical bonds with the ductile casting, can also be, according to another advantageous embodiment, assumed by two or more semi-tubular interconnected depressions extending on the longitudinal sides of the inserts, from the wear surface to the inner surface, provided with alternating axially restricting and widening passages. These semi-tubular depressions are interconnected with each other through a depression extending on the longitudinal sides of the inserts from the outer wearing surface to the inner surface. On each end of the longitudinal sides, a protruding rib is provided which forms the only contact zone between two adjacent inserts. The mechanical bonds between the inserts and the casting are formed, to a large extent, by the (second metal) cast filling the interconnected semi-tubular depressions (with alternating restricting and widening passages) and thus maintaining the inserts solidly in their position.

According to an advantageous embodiment, the inserts extend from one of the bases of the ferrule and terminate before the opposite base in order to define a peripheral ring of ductile casting at that point.

The invention also provides a crusher hammer constituted from a part in the shape of a sector of circle whose inside point comprises an opening through which a suspension and pivoting shaft can be passed and which is produced according to the method proposed above, characterised in that the point forms a support made from machinable ductile casting and in that the outer section is an insert having a high resistance to wear and in that the insert and the support are integral with each other by means of a mechanical bond.

This mechanical bond can be provided by a central prolongation of the insert or of the support, this prolongation being provided with lateral channels. This bond can furthermore be reinforced by a frontal groove on the support or on the insert.

The mechanical bond can also be provided by an interior sector of the insert having a reduced thickness and with a transverse opening, the said sector of reduced thickness being embedded in the support by the casting of the latter.

Other characteristics and features of the invention will emerge from the detailed description of several embodiments given below by way of illustration with reference to the appended drawings.

Figure 1:
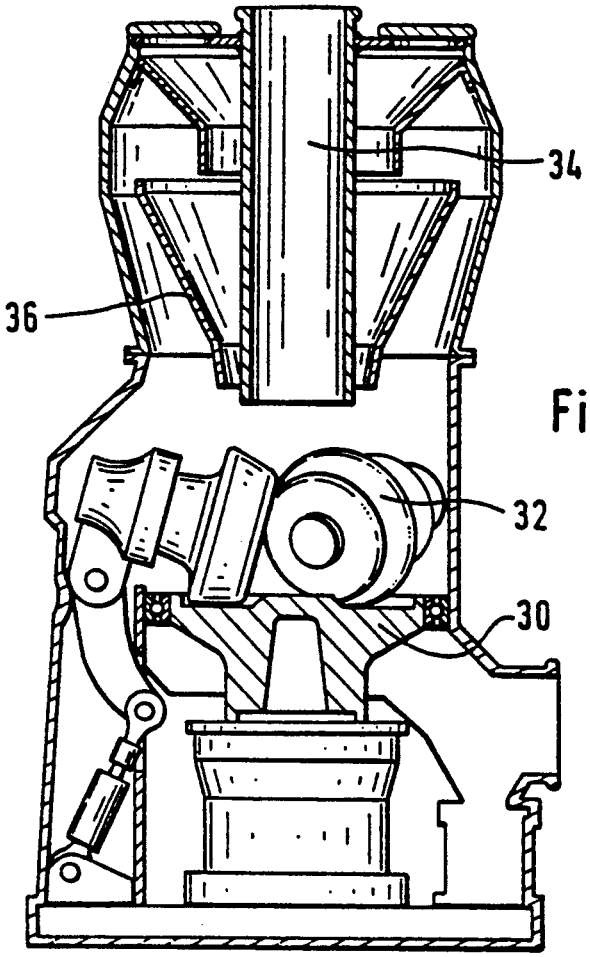
FIG. 1 is diagrammatic view of a vertical crusher.
Figure 2:
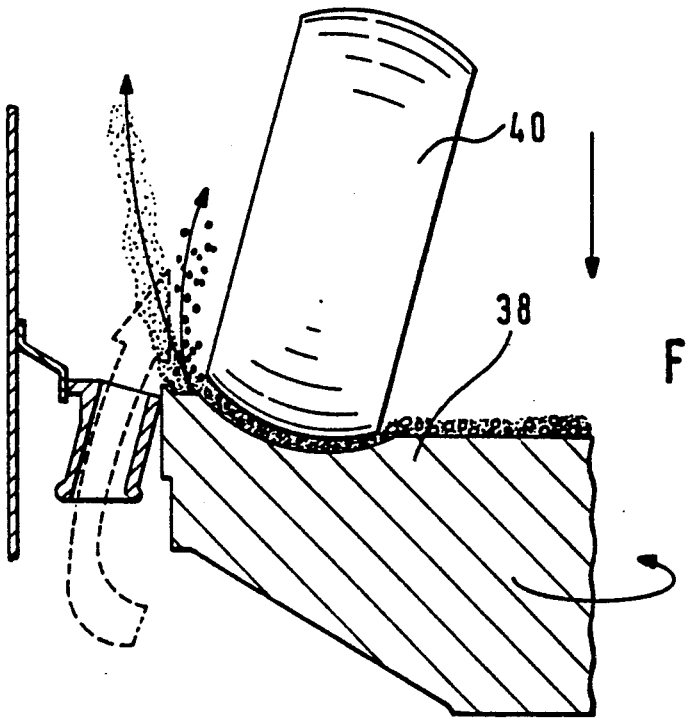
FIG. 2 shows details of a crusher at the point of crushing.

A first advantageous application of the use of composite wearing parts manufactured in accordance with the present invention will now be described with reference to a vertical crusher with wheels such as shown diagrammatically in FIG. 1 but which will also be valid for a press with rollers. Such crushers are, for example, used for crushing coal or clinker. They are essentially constituted by a rotary track 30 over which crushing wheels 32 move. The material to be crushed is introduced through a central feed channel 34 and falls onto the track 30 where it is squashed and crushed between that track and the wheels 32. As shown in greater detail in FIG. 2, the crushed material is taken up, at the periphery of the track 30, by a upward current of hot air and at the same time is separated under the effect of gravity and of a separator 36 according to the granulometry. In order to avoid friction between the wheels 32 and the track 30, the wheels 32 must have a truncated cone shape as shown in FIG. 1. It is also possible to provide wheels 40, as in the embodiment shown in FIG. 2, having a convex rolling surface, the track 38 having a corresponding concave annular surface.

The crushing wheels are generally constituted by an annular ferrule having a cylindrical or truncated cone shape, mounted on a hub. They must, on the one hand, have a sufficient resistance to the wear caused by the crushing and, at the same time, be able to be machined in order to be mounted on the hub. The known ferrules are generally cast in Ni-hard alloy or in ferrochromium and then machined with high precision, (inside diameter with an H6 tolerance in certain cases) before being mounted on their hubs.

In service, the wear of such a ferrule progresses in a generally uniform manner at all points along a circular line over a radial section. On the other hand, the wear is generally variable along a same generatrix, the ends, in particular the peripheral ends, wearing more slowly then the central section. Furthermore, a progressive polishing of the working surface is caused resulting in an increased risk of slipping between the ferrule and the material to be crushed.

The result of this is that the profile of the working surfaces becomes modified and the system for taking up play no longer allows the optimum crushing conditions to be restored. Furthermore, as the outer surface becomes polished, the slipping between the material to be crushed and the surface of the ferrule accelerates the wear and reduces the output rate, particularly if the material to be crushed is wet.

Figure 3:
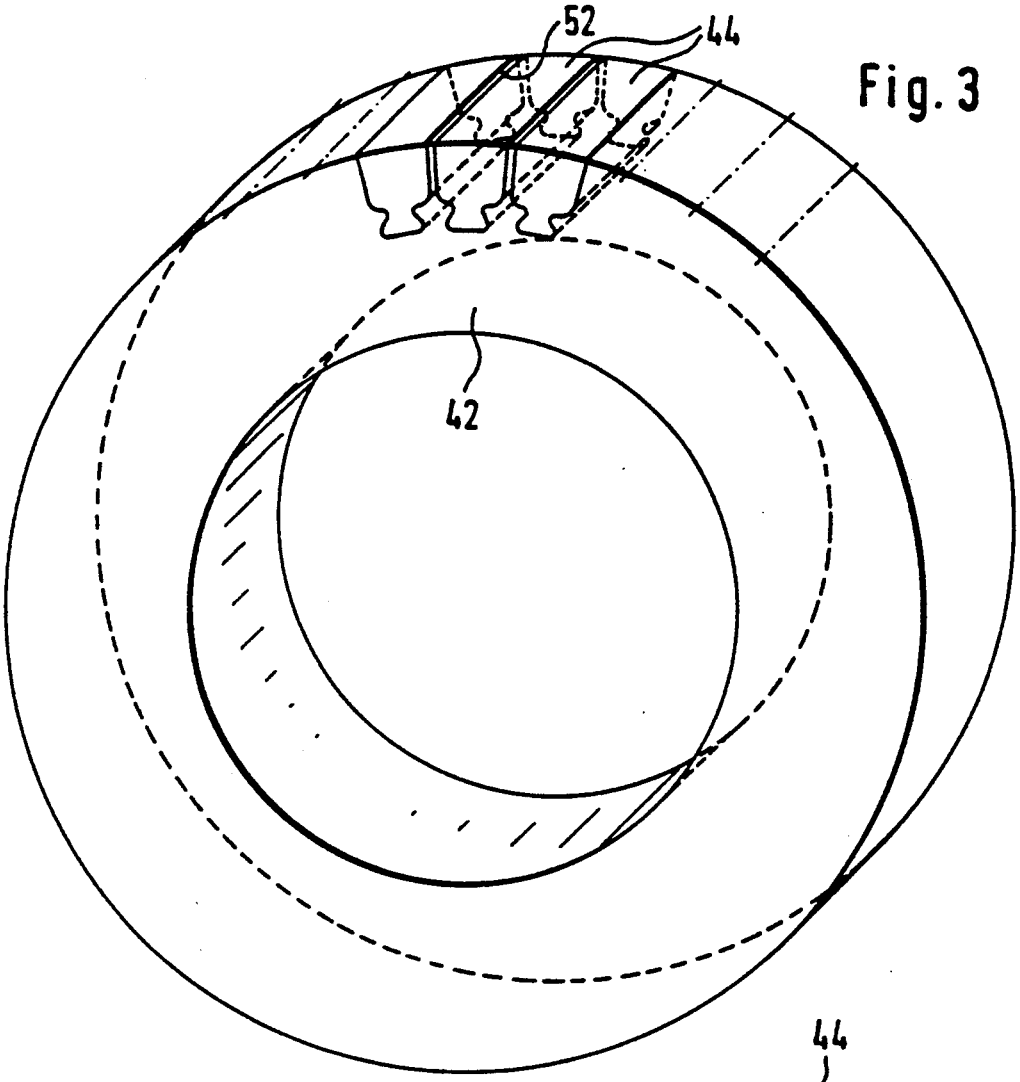
FIG. 3 is a perspective view of a ferrule of a crushing wheel according to the present invention.

In order to overcome these disadvantages, the present invention proposes, in its application to a crusher, to produce the ferrules with inserts as shown generally in FIG. 3. Such a ferrule is therefore constituted by an annular support 42 made from ductile and machinable casting, in which are embedded peripheral inserts 44 made from a material having a high resistance to abrasion, for example ferrochromium, and forming the working and wearing surface of the ferrule.

Figure 4:
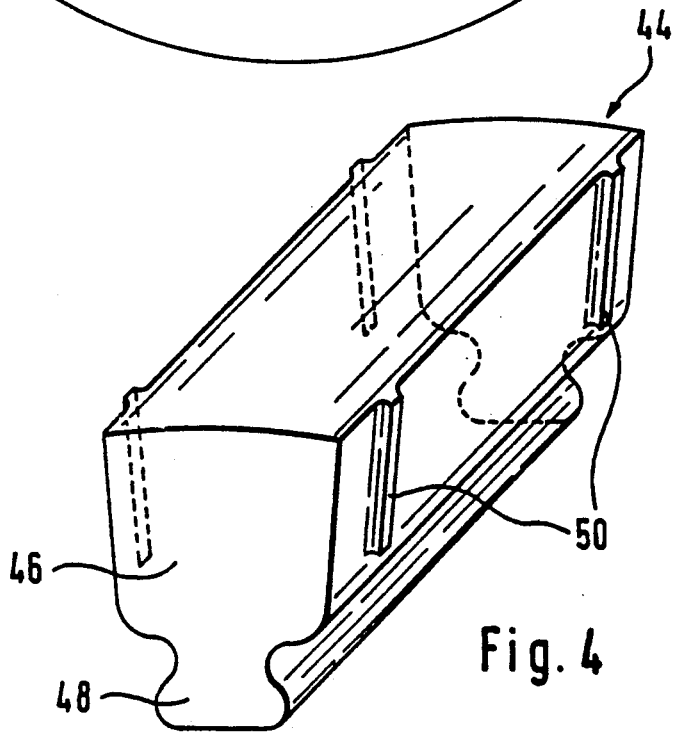
FIG. 4 is a perspective view of a first embodiment of an insert, according to the present invention, of a crushing ferrule.

The inserts 44 are firstly cast separately in appropriate moulds. These inserts 44 advantageously have the shape shown in perspective in FIG. 4. They are constituted by an outer section 46 having a substantially parallelepipedic shape and a cross-section which is slightly that of a truncated cone along the radius of curvature of the ferrule. This section is prolonged towards the base, or the inside of the ferrule, by a longitudinal narrowed foot 48 having a radial cross-section of "dovetail" shape and forming the zone of bond with the support 42. Each insert 44 comprises, on at least one of its longitudinal sides of the section 46, in the embodiment shown, two protruding ribs 50.

The inserts 44 are then placed in the mould for the casting of the ferrules in such a way as to line the entire periphery of the mould. The inserts 44 are juxtaposed in such a way that their ribs 50 are in mutual contact in order to define, between two juxtaposed inserts, a space 52' width depends on the size of the ribs 50. The purpose of these ribs 50 is to cause, during the casting of the support 42, a spreading of the ductile casting into the spaces 52' in order to form, between all of the adjacent inserts 44, a fine radial fin of ductile casting. Concomitantly, the ribs 50 enable, before the casting of the support 42, the inserts 44 to form a "vault" on the entire circumference of the mould. This vault anchors the inserts 44 solidly in the mould so that they will not be "washed away" when the molten metal (second alloy) is poured into the mould and, during the casting of the support 42, a spreading of the ductile casting into spaces 52' in order to form, between all of the adjacent inserts 44, a fine radial fin 52 of the ductile casting.

According to one of the features of the present invention the casting of the ferrule is carried out in such a way as to avoid any metallurgical bond between the support 42 and the inserts 44. For this purpose the inserts 44 can undergo a preliminary preparation, for example a heat treatment in order to reduce cracking risks. If the massiveness of the inserts 44 is relatively large with respect to the support 42 it is among other things possible to coat the insert 44, before casting the ferrule, with a refractory coating intended to form a thermal barrier.

The temperature of the material forming the support 42 must therefore no longer be as high, during the casting of the ferrule, as in the case of a casting with the formation of a metallurgical bonding. This has the advantage of reducing the thermal shocks which the inserts 44 undergo during this casting. The latter are consequently less exposed to the risks of crack formation. If, despite this precaution, a crack should form in the insert 44, this crack would not propagate beyond the insert given that the absence of metallurgical bond prevents its progression through the material of the support 42. In other words, the method proposed by the invention reduces the risk of formation of cracks in the inserts 44 and furthermore prevents their progression through the support.

Another purpose of the fins 52 is to cause, by the working of the wheel, a preferential wear of the ductile alloy and the formation of grooves between the inserts 44 for the purpose of gripping the material to be crushed. In order to have optimum output it is therefore necessary to choose the spacing between the inserts 44 as a function of the friction characteristics of the material used, of its granulometry and of its angularity.

The morphology and the shape of the inserts 44 is therefore dictated by several criteria. Their width and their spacing must allow a circumferential pitch offering an optimum driving of the material used. The profile of the section 48 of each insert 44 allows excellent mechanical bonding between the inserts 44 and the support 42 with a minimum of concentration of tension in the ferrochromium of the inserts. The radial height of the inserts 44 allows a large usable thickness and good mechanical bonding up to the end of its service life. Finally, the ribs 50 allow easy adjustment and positioning of the inserts 44 in the mould as well as fixation relative to the mould axis.

A ferrule produced with inserts such as described above has several advantages with respect to the known ferrules. The machining and ferruling operation is less delicate and less expensive because of the ductility of the support 42. This ductility also reduces risks of sudden fracture through the complete cross-section of the part as a result of static ferruling stresses and of operational fatigue. It is possible to use cast irons with a high chrome content, that is to say with very great hardness (greater than 65 Rc) the machining of which is extremely difficult and expensive. At the same time, the manufacturing method allows a better rate of use of the costly ferrochromium.

In addition to the advantages listed above which in fact are intrinsic advantages due to the properties of each of the materials present, the association of these materials generates a synergic effect offering other advantages. Thus, for example, it is possible to achieve a compression of the inserts by the expansion of the ferrochromium during its martensitic transformation during hardening, while the ductile casting completes its cooling with a linear shrinkage. This compression of the working surface has a positive effect on its resistance to fatigue and also, in certain cases, on its resistance to abrasion. Furthermore, it is possible to generate a wearing surface retaining the initial profile with, in addition, hollows between the inserts which favour the driving of the material. In brief, the ferrules produced according to the proposed methods offer an increased resistance to wear, an increased mechanical reliability and an increased production rate during their service life.

A method of producing a ferrule allowing compensation of the wear profile along the generatrix will now be described with reference to FIGS. 5 to 14. In fact, an irregular wear profile along the generatrix is particularly harmful in the case of vertical crushers with wheels according to FIG. 1 in which the material is displaced radially on the track along the generatrix of the wheels and where the formation of a pocket between the wheel and the track is responsible for harmful consequences. In fact, the production rate can drop to 50% of the nominal production rate obliging a premature replacement or re-machining of the wheels before the entire useful thickness of the wearing layer is worn out. Furthermore a metal-to-metal contact is produced between the slightly worn ends of the wheel and of the track which causes a rapid deterioration of these wearing parts. These disadvantages are even more pronounced in the case of flat tracks and of wheels having straight generatrices like those shown in FIG. 1. In such a case there is an advantage in using the possibilities of the manufacturing method according to the present invention in order to take advantage of the presence of two materials having different properties in order to accelerate the wear of the regions which wear less than others by consequently modifying the morphology of the inserts.

Figure 5:
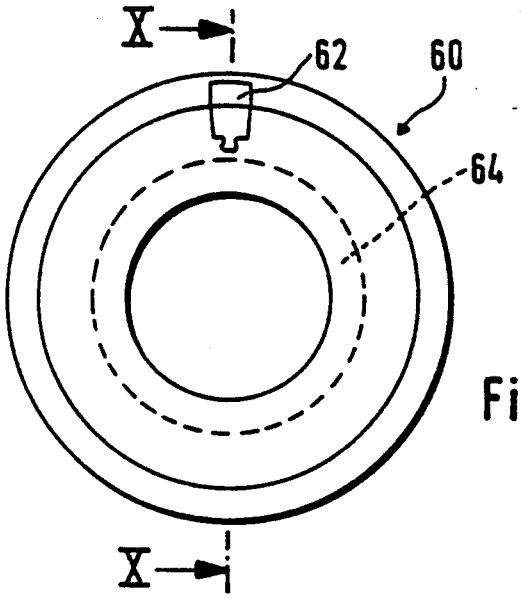
FIGS. 5 and 6 respectively show a radial cross-section and an axial cross-section of a variant of the ferrule shown in FIG. 7.
Figure 6:
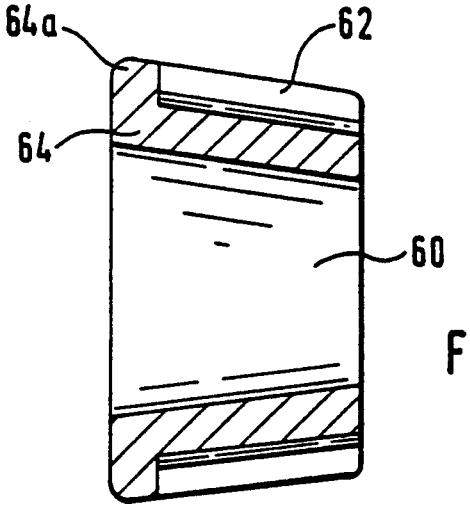
Figure 7:
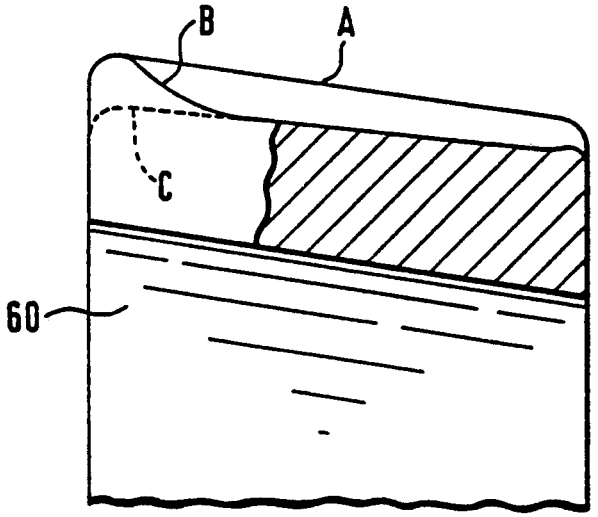
FIG. 7 shows the peripheral wear of a ferrule.

As shown in FIGS. 5 and 6, the ferrule 60 comprises inserts 62 which do not extend over the entire length of the generatrix in such a way as to allow a peripheral nose 64*a*, which is part of the ductile casting support 64 to remain on the outer edge of the wheels. A faster wear is therefore voluntarily provoked in this region of the wheel in order to compensate for the fact that this region normally wears more slowly. FIG. 7 shows the development of the wear of such a ferrule 60. The profile identified by A represents the outer circumference of the ferrule 60 in the new unworn state. The line B represents the development of the wear profile when the ferrule has a uniform hardness over the entire length of its generatrix, while the dashed line C represents the development of the wear profile such as corrected by a ferrule according to FIG. 6 with a more ductile outer edge 64*a*.

Figure 8:
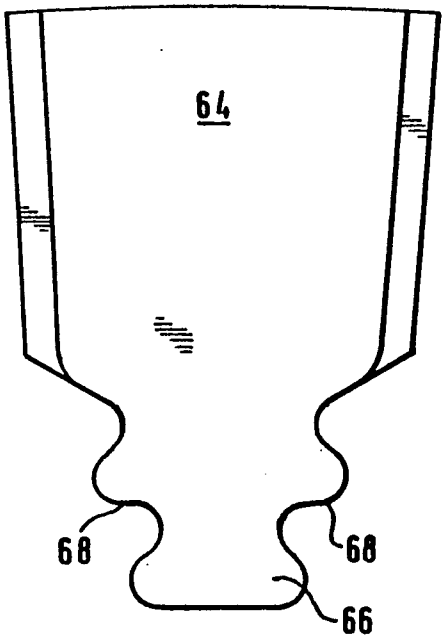
FIG. 8 shows a view, similar to that of FIG. 4, of a second embodiment of an insert of a crushing ferrule.

As mentioned above, the special shape of the inserts 44, particularly their dovetail shape 48 contributes to consolidating the mechanical bonding between the inserts 44 and the support 42. When the inserts are relatively massive, it is possible, in order to increase the contact surface while avoiding having to make cuts which are too deep in order to form the dovetail shapes, to provide inserts such as shown in FIG. 8. Such an insert 64 is comparable with the inserts 44 of FIG. 4 except that the inside section 66 comprises, on its two longitudinal sides, corrugations or channels 68 forming a kind of multiple dovetail. The mechanical bonding zone is therefore separate and is, in effect, behind the wear zone, which avoids a certain number of disadvantages at the end of the service life with respect to the simple dovetail becoming level with the working surface.

Figure 10:
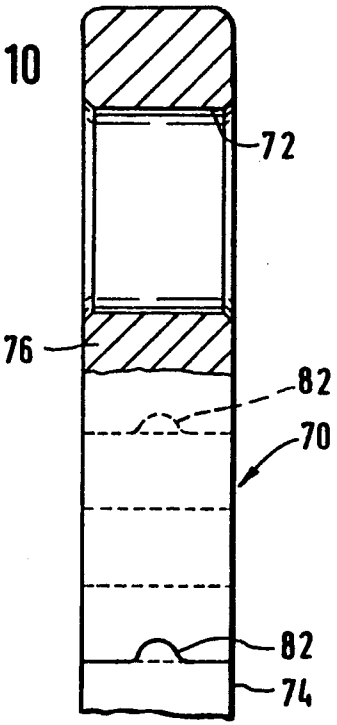
FIG. 10 is a central, vertical cross-section of the hammer shown in FIG. 9.
Figure 9:
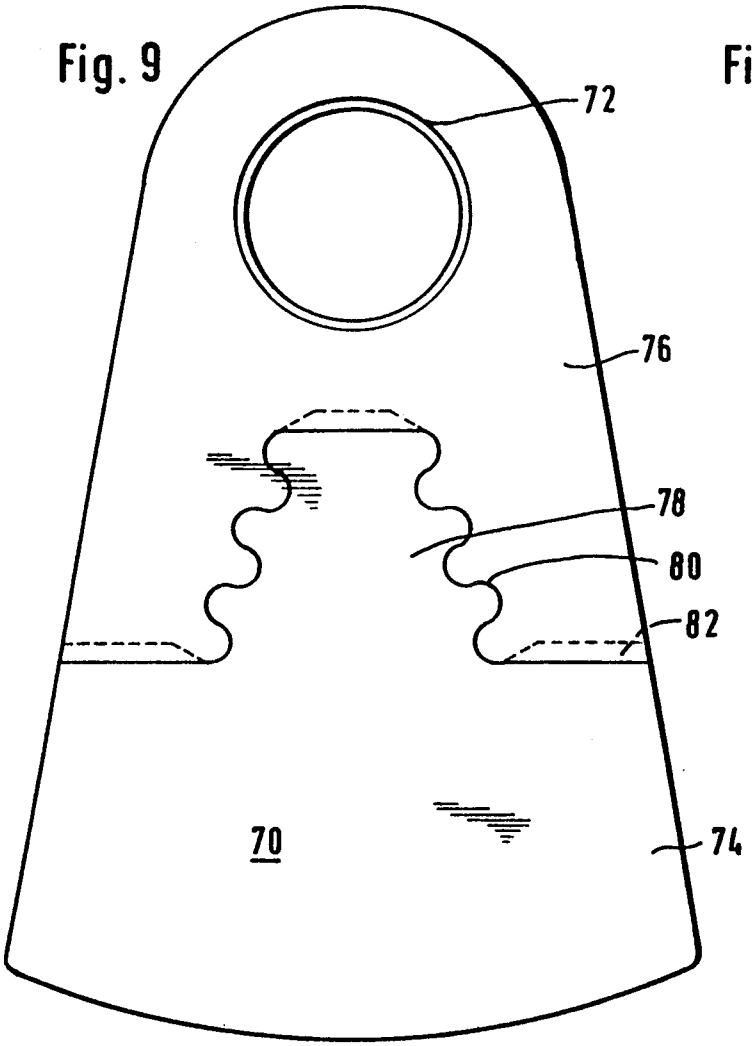
FIG. 9 is a side view of a crusher hammer produced according to the present invention.

FIGS. 9 and 10 show another application using a composite casting produced in accordance with the present invention. In this instance it is a crusher hammer. Such crushers generally comprise a rotary drum on the surface of which crusher hammers are attached in a pivoting manner on longitudinal shafts. The hammer 70 shown in FIG. 9 has a shape which is approximately a sector of circle with a bore 72 for mounting on a shaft in a crusher with hammers. This hammer is a bimetal casting produced according to the present invention and comprises an insert 74 made from a material with a high resistance to wear and a support 76 made from a more ductile material resistant to stresses. The insert 74 is firstly cast in a first mould and the support 76 is then cast over the insert 74 in another mould. The bond between the support 76 and the insert 74 is an exclusively mechanical bond. In order to consolidate this bond, it is preferable to produce an insert 74 having, on the side of its bond with the support 76, a prolongation 78 provided with lateral channels 80. The number of these channels depends on the desired solidity to be obtained for these bonds. It is possible, for example, to provide just a single channel in order to produce a dovetail shaped bond. Instead of providing the channels 80 on a prolongation of the insert 74 it is also possible to provide them in a cut-out in the insert 74 in order that the support extends inside the latter.

In order to improve the fixing in the transverse direction, that is to say perpendicular to the plane of FIG. 9, it is possible to provide, on the front side of the insert 74, on the side of the support 76, a protruding rib 82 or a groove. The reference 82 (see FIG. 10) shows such a consolidating rib.

Figure 12:
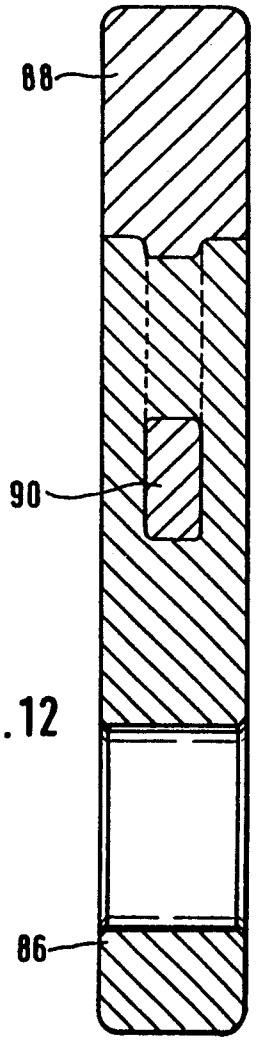
FIG. 12 shows the central vertical cross-section of the hammer shown in FIG. 11.
Figure 11:
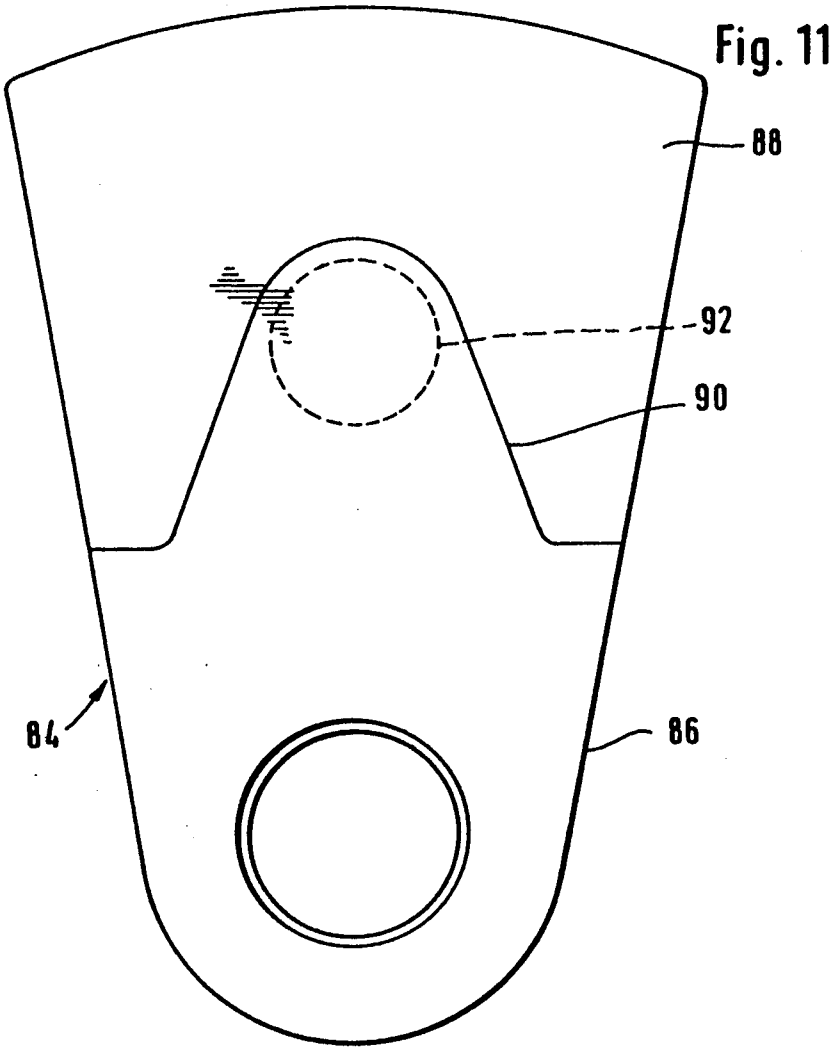
FIG. 11 shows a second embodiment of a crusher hammer.

FIGS. 11 and 12 show another embodiment of a crusher hammer 84 produced according to the present invention. The hammer 84 also comprises an insert 88 having a high resistance to wear, over which is cast a ductile support 86. The insert 88 comprises, on the side of the support 86, a sector 90 of thickness reduced (see FIG. 12) for example to the central third of the thickness of the rest of the insert 88. This sector 90 furthermore comprises a transverse opening 92. During the casting of the support 86, the casting takes place on either side of the sector 90 of reduced thickness and through the opening 92 in order to form the configuration shown in cross-section in FIG. 12. The support 86 and the insert 88 are therefore perfectly integrated in each other with an extremely stable mechanical bond in both the transverse and longitudinal directions. This embodiment furthermore has the advantage that the wear of the insert 88 follows the shape of the ductile support 86.

Figure 13:
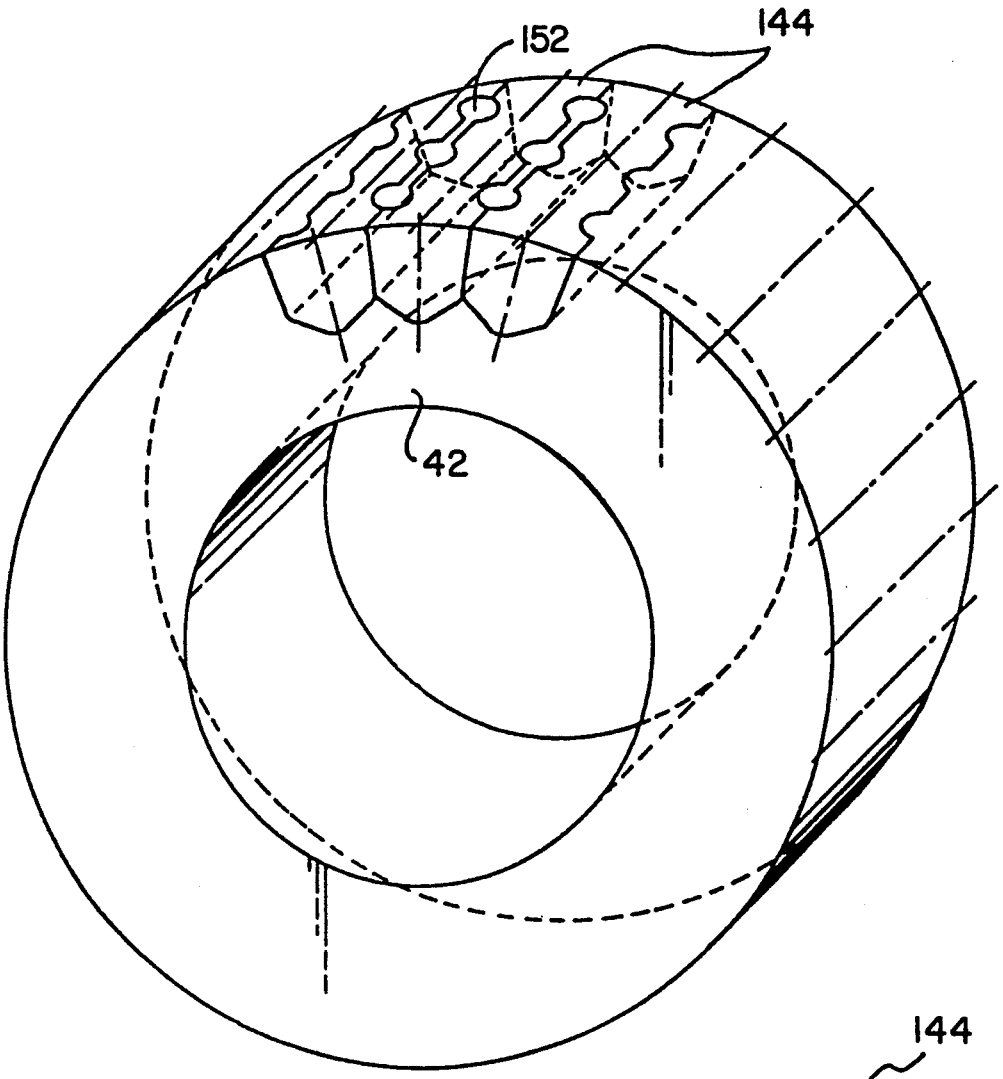
FIG. 13 shows a perspective view of a ferrule of a crushing wheel according to a preferred embodiment of the present invention.
Figure 14:
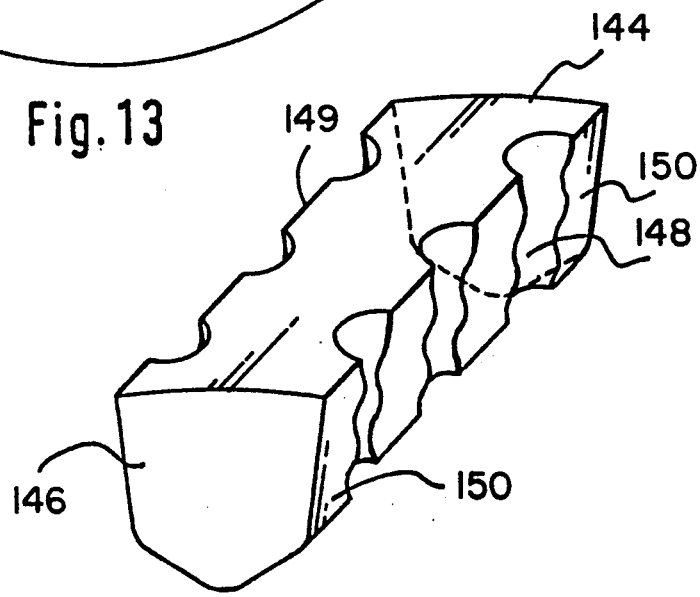
FIG. 14 is a perspective view of the FIG. 13 embodiment of an insert of a crushing ferrule.

FIG. 13 shows a perspective view of a ferrule of a crusher wheel constituted by an annular support 42 on which inserts 144 are embedded on the periphery. These inserts 144 are shown in more detail in a perspective view on FIG. 14.

Yet another possibility to provide a zone for mechanical bonding, as mentioned above, is shown by the inserts 144, comparable with the other above mentioned inserts except that they have no dove tail shape. These inserts 144 are provided with two or more semi-tubular depressions 148 which are interconnected with each other by a depression 149 extending on the longitudinal sides of the inserts 144 from the outer wearing surface to the inner surface. On each end of the longitudinal sides a protruding rib 150 is provided which forms the only contact zone between two adjacent inserts, much the same as the ribs 50 seen in FIG. 4. The mechanical bonds between the inserts and the casting are formed, to a large extent, by the cast filling the interconnected semi-circular tubular depressions 148 provided with alternating restricting and widening passages and, thus, maintaining the inserts solidly in their position. A radial fin 152 of ductile casting, having the shape (cross sectional profile) of a rosary, is formed between adjacent inserts.

Finally, it must be emphasised that the two applications described above, have been presented only by way of illustration. Other applications exist which are capable of benefiting from the advantages offered by the present invention, particularly applications with composite wearing parts having a high insertion rate, for example ferrules which can be used on cylinder-type de-agglomerators used at the output of cooling units in order to break up the scale and in which the insertion rate can be in the order of 80%.

I claim:

1. Method for manufacturing a composite bimetal wearing part including inserts having two longitudinal sides made of a first metal alloy with high resistance to wear and a cast support made from a second more ductile metal alloy resistant to mechanical stresses comprising the steps of:

providing said inserts with at least one protruding rib on the longitudinal sides of said inserts;

disposing said inserts one against another and against an axially symmetrical mould circumference in a manner such that adjacent inserts are separated by a spacing defined by said protruding ribs on said longitudinal sides of said inserts; and casting said second more ductile metal in said mould so as to fill the hollow space of said mould forming a radial fin between two adjacent inserts whereby said casting is carried out in such a way as to establish only a mechanical bonding between said inserts and said support being purely mechanical due an appropriate geometrical shape of said inserts.

2. Method for manufacturing a composite bimetal wearing part according to claim 1 wherein said mould is a cylinder.

3. Method for manufacturing a composite bimetal wearing part according to claim 1 wherein said mould is a truncated cone.

4. Method for manufacturing a composite bimetal wearing part according to claim 1 wherein said mould is an annulus.

5. Method according to claim 1 wherein the inserts are prepared by a heat treatment, a refractory or a ceramic coating treatment before the second metal is cast.

6. In a method for manufacturing a composite bimetal wearing part including cross-sectionally tapered inserts having defined root and wear surfaces, each insert made of a high wear-resistant first metal alloy, and a support which is cast of a second metal alloy more ductile than said first and mechanically stress resistant, an improvement for maximizing total insert wearing surface of the part characterized by the shape of:

providing each insert a longitudinally elongate shape having an essentially orthogonal cross-sectional taper, which taper increases towards said defined wear surface, while further providing longitudinally thereon at least one protruding rib having at least one nonlinear feature;

disposing the inserts adjacently, while contacting one another, along the circumference of an axially symmetrical mould so that said inserts wear surfaces are directed radially outward and spacing between adjacent inserts is defined by at least one protruding rib of an insert, and further providing therebetween, by said disposing, a plurality of narrow elongate voids for investment therein of said second alloy, whereby a high insert dispositioning rate is attained along said circumference; and casting the second alloy in said mould and filling thereby all spaces and voids thus forming a radial fin in each said narrow elongate investment void and effecting the mechanical bonding of each insert to the mould by capturing therein said nonlinear feature of each rib, whereby realizing the wearing part by the aforesaid steps, particularly attaining said high, contacting insert dispositioning, effects a maximizing of total wear surfaces of said part.

* * * * *